US005620162A

United States Patent [19]

Beckwith et al.

[11] Patent Number: 5,620,162

[45] Date of Patent: Apr. 15, 1997

[54] ADJUSTABLE PAPER HOLDER

[75] Inventors: Tanya L. Beckwith, Eagan; Wayne K. Darvell, St. Paul, both of Minn.; Lawrence J. Fenske, Oregon Township, Dane County, Wis.; Kenneth J. Kirchhoff, Gem Lake; Lynette M. Miles, Lakeville, both of Minn.; Steven C. Suchanek, Madison, Wis.; Warren J. Wasescha, Maplewood, Minn.

[73] Assignee: Minnesota Mining and Manufacturing Company, St. Paul, Minn.

[21] Appl. No.: 324,650

[22] Filed: Oct. 18, 1994

[51] Int. Cl.[6] ..... B41J 11/02

[52] U.S. Cl. ..... 248/442.2; 248/918; 248/447.2; 248/452

[58] Field of Search ..... 248/918, 442.2, 248/452, 282, 231.4, 448, 447.2, 458, 279, 205; 40/341; 400/718

[56] References Cited

U.S. PATENT DOCUMENTS

| | | | |
|---|---|---|---|
| D. 309,607 | 7/1990 | Nemeth | D14/114 |
| D. 316,115 | 4/1991 | Davis et al. | D19/86 |
| D. 316,275 | 4/1991 | Davis et al. | D19/86 |
| D. 327,501 | 6/1992 | Maloney | D19/86 |
| D. 327,502 | 6/1992 | Maloney | D19/86 |
| 1,458,457 | 6/1923 | Amez-Droz . | |
| 4,249,336 | 2/1981 | Moe et al. | 46/17 |
| 4,364,537 | 12/1982 | Helzer | 248/448 |
| 4,582,285 | 4/1986 | Bello | 248/442.2 |
| 4,767,093 | 8/1988 | Jones | 248/442.2 |
| 5,078,358 | 1/1992 | Egly et al. | 248/447.1 |
| 5,082,235 | 1/1992 | Crowther et al. | 248/918 |
| 5,292,099 | 3/1994 | Isham et al. | 248/442.2 |
| 5,385,327 | 1/1995 | Hegarty et al. | 248/442.2 |

FOREIGN PATENT DOCUMENTS

| | | |
|---|---|---|
| 2019333 | 12/1991 | Canada . |
| 0064028A2 | 11/1982 | European Pat. Off. . |
| 0482304A1 | 4/1992 | European Pat. Off. . |
| 0569316A2 | 4/1993 | European Pat. Off. . |
| WO88/06856 | 9/1988 | WIPO . |

OTHER PUBLICATIONS

Wordysturdy™—Contents and Assembly Instructions.

*Primary Examiner*—Korie Chan
*Assistant Examiner*—Gwendolyn W. Baxter
*Attorney, Agent, or Firm*—Gary L. Griswold; Walter N. Kirn; William L. Huebsch

[57] ABSTRACT

An adjustable paper holder including an elongate support member adapted to be attached along either side of a computer monitor with the support member extending generally parallel to its front surface; and a sheet support plate that is mounted on the support member for pivotal movement around both a normally horizontal pivot axis that is generally normal to the length of said support member and parallel to the front surface of the computer monitor and a second pivot axis parallel to the edges of the sheet support plate and adjacent one of its edges, and also mounted for movement of its normally horizontal pivot axis longitudinally of the support member. A paper clamp assembly is mounted on the sheet support plate with a surface on the clamp plate against which paper is clamped generally coplanar with the front surface of the sheet support plate, and is moveable to accommodate different length papers to be held on the sheet support plate.

10 Claims, 5 Drawing Sheets

ADJUSTABLE PAPER HOLDER

FIELD OF THE INVENTION

The present invention relates to adjustable paper holders adapted for use with or on a computer monitor to hold paper from which the operator of the computer is reading or typing while working on the computer.

BACKGROUND OF THE INVENTION

The prior art is replete with adjustable paper holders adapted for use with or on a computer monitor to hold paper from which the operator of the computer is reading or typing while working on the computer. U.S. Pat. Nos. 4,767,093; 5,078,358; 5,292,099; Des. 309,607; Des. 316,115; Des. 316,275; Des. 327,501; and Des. 327,502 together with EP 0,569,316 A2 provide illustrative examples. While many of these paper holders can hold such papers in a position where they are readily visible by the operator of the computer, known paper holders of this type lack the degree of adjustability that may be desired particularly when the operator is reading from paper of different sizes.

DISCLOSURE OF THE INVENTION

The present invention provides an adjustable paper holder adapted for use with or on a computer monitor to hold paper from which the operator of the computer is reading or typing while working on the computer which both can hold such a paper in a position where it is readily visible by the operator of the computer, and has a high degree of adjustability that is particularly useful when from time to time, the operator is reading from paper of different sizes including letter, A4 or legal size paper.

According to the present invention there is provided an adjustable paper holder including (1) an elongate support member adapted to be attached along either one of the side surfaces of a computer monitor with the length of the support member extending generally parallel to the front or viewed surface of the computer monitor; (2) a sheet support plate; (3) means mounting the sheet support plate on the support member for pivotal movement both around a first normally horizontal pivot axis generally normal to the length of the support member and parallel to the front surface of a computer monitor to which the support member is attached, and around a second pivot axis parallel to the edges of the sheet support plate and adjacent to one of the edges, and mounting the sheet support plate for movement of the normally horizontal pivot axis between first and second positions longitudinally of the support member; (4) means for frictionally retaining the sheet support plate at any desired position relative to the support member that the support plate can be moved by the mounting means; (5) a clamp assembly comprising a clamp plate having a planar clamping surface and an upper edge, a clamp, means mounting the clamp on the clamp plate along the upper edge for movement between a clamping position engaged with the edge portion of a sheet of paper along the clamping surface, and a release position spaced from the clamping surface, and means for biasing the clamp to the clamping position, the clamp being manually engageable to move the clamp to the release position; and (4) means mounting the clamp plate on the sheet support plate with the clamping surface of the clamp plate generally co-planar with the front surface of the sheet support plate and the upper edge of the clamp plate generally parallel with the top edge of the sheet support plate for movement between a legal paper holding position, to a landscape holding position.

Use of the adjustable paper holder on a computer monitor allows a document on the paper holder to be positioned close to and in the same visual plane as the screen on the computer monitor so that eye and head movements of a person using the monitor and the paper holder will be limited to less than 30 degrees to the side of the users focal point on the monitor screen and the users head can be held in a relaxed, "neutral" position that will minimize neck and eye strain. Also, the paper holder can be adjusted to a position that minimizes glare from lights and reflections on a paper held on the paper holder, and such adjustments can be easily made, even by persons having handicaps such as low strength or arthritis.

BRIEF DESCRIPTION OF DRAWING

The present invention will be further described with reference to the accompanying drawing wherein like reference numerals refer to like parts in the several views, and wherein:

FIG. 6 is an exploded top right front perspective view of a second subassembly included in the adjustable, paper holder of FIG. 1; and.

DETAILED DESCRIPTION

Figure 1:
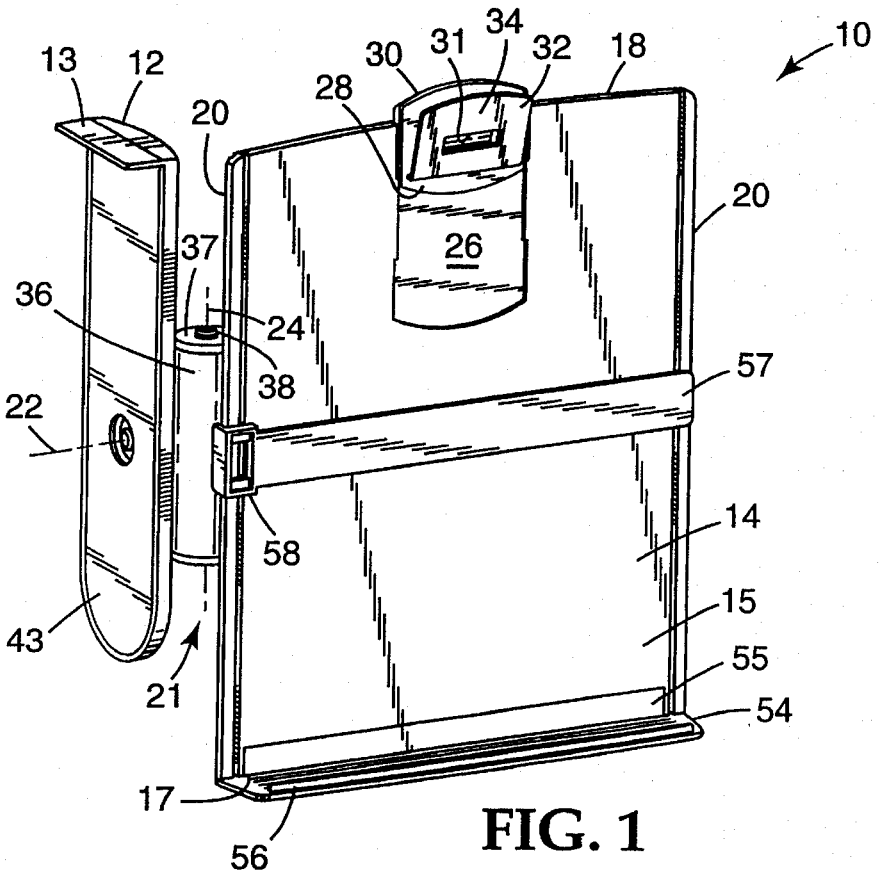
FIG. 1 is a top left front perspective view of an adjustable paper holder according to the present invention in which a support member is located on the left side of a sheet support plate included therein.

Referring now to the drawing, there is shown an adjustable paper holder according to the present invention generally designated by the reference numeral 10, which adjustable paper holder 10 is adapted for use on a conventional computer monitor (not shown) having a viewed front surface and normally vertical opposite side surfaces disposed at about right angles with respect to its viewed surface.

Generally the paper holder 10 comprises an elongate support member 12 adapted to be attached along either one of the side surfaces of the monitor with the length of the support member 12 extending generally parallel to the front surface and a lip 13 projecting normal to the length of the support member 12 at its upper edge along the top surface of the monitor; a sheet support plate 14 having front and rear major surfaces 15 and 16, a bottom edge 17, an opposite top edge 18, and side edges 20 extending between the top and bottom edges 18 and 17; and adjustable mounting means mounting the sheet support plate 14 on the support member 12. The adjustable mounting means mounts the sheet support plate 14 on the support member 12 for pivotal movement (1) around a first normally horizontal pivot axis 22 generally normal to the length of the support member 12 and parallel to the front surface of a computer monitor to which the support member 12 is attached, and (2) around a second pivot axis 24 parallel to the edges 20 of the sheet support plate 14 and adjacent one of the edges 20; and also mounts the normally horizontal pivot axis 22 for movement between first and second positions longitudinally of the support member 12. Friction means, later to be explained, are provided for frictionally retaining the sheet support plate 14 at any desired position relative to the support member 12 that the support plate 14 can be moved by the mounting means. A paper clamp assembly is provided that comprises a clamp plate 26 having a planar clamping surface 28 and an upper edge 30, a clamp 32, and means in the form of a semi cylindrical spring clip 33 engaged over lips 31 on the clamp 32 and clamp plate 26 for both mounting the clamp 32 on the clamp plate 26 along its upper edge 30 for movement between a clamping position engaged with the edge portion of a sheet of paper along the clamping surface 28, and a release position spaced from the clamping surface 28, and for biasing the clamp 32 to its clamping position. The clamp 32 is manually engageable at a projecting portion 34 thereof to move the clamp 32 to its release position. The clamp plate 26 is mounted on the sheet support plate 14 in a channel defined by portions 27 thereof with the clamping surface 28 of the clamp plate 26 generally co-planar with the front surface 15 of the sheet support plate 14 and the upper edge 30 of the clamp plate 26 generally parallel with the top edge 18 of the sheet support plate 14 for movement between (1) a legal paper position (i.e., with the clamp 32 spaced about 14 inches from the bottom edge 17 of the sheet support plate 14) and a landscape position (i.e., with the clamp 32 spaced about 8 inches from the bottom edge 17 of the sheet support plate 14 which is useful when sheets are supported with their long dimensions parallel to the bottom edge 17 and their narrow dimensions between the bottom edge 17 and the clamp 32), with letter and A4 paper positions therebetween (i.e., with the clamp 32 spaced about 10 inches and 11 inches respectively from the bottom edge 17 of the sheet support plate 14). Friction provided by a button supported on a flexible projection 29 of the sheet support plate 14 and spaced openings along the clamp plate 26 helps to retain the clamp plate 26 in those positions.

The means mounting the sheet support plate 14 on the support member 12 for pivotal movement around the second pivot axis 24 comprises a hinge like structure including first and second hinge members 36 and 37 having pivot portions mounted on each other for pivotal movement around the second pivot axis 24 by bolts 38 passing through openings 35 therein. The second hinge member 37 has a rectangular spade-like projecting portion 39 projecting at about a right angle to the second pivot axis 24. The sheet support plate 14 has means along its rear surface 16 in the form of spaced rails 40 with opposed lips projecting toward each other from their distal edges for frictionally and removably receiving the projecting portion 39 with the pivot portion adjacent either of the edges 20 of the sheet support plate 14. The first hinge member 36 has a projecting portion 31 normally projecting at about a right angle to the second pivot axis 24 and includes means defining at least a portion of the first normally horizontal pivot axis 22. A slide bar 41 is mounted on the support member 12 for longitudinal sliding movement. The slide bar 41 also includes means defining a portion of the first normally horizontal pivot axis 22, with sliding movement of the slide bar 41 causing the movement of the normally horizontal pivot axis 22 to any position between first and second positions longitudinally of the support member 12.

The slide bar 41 is mounted on the support member 12 for longitudinal sliding movement between spaced rails 42 extending longitudinally along the support plate 14, and is retained between those rails 42 by a retaining plate 43 that is fixed over the rails 42 by having elongate rails 44 on the retaining plate 43 attached as by sonic welding along the outer edges of the rails 42. The first normally horizontal pivot axis 22 is defined by a bolt 45 passing through openings 48 in the slide bar 41 and the first hinge member 36, and the slide bar 41 includes a cylindrical collar 46 around its opening 48, the outer surface of which collar 46 is slidably received in an elongate slot 47 through the support member 12, the ends of which slot 47 define the first and second positions of the slide bar 41.

The friction means for frictionally retaining the sheet support plate 14 at any desired position relative to the support member 12 that the support plate 14 can be moved by the mounting means is provided by friction members (e.g., of resiliently compressible polymeric foam material that undergoes a minimum of compression set, such as a closed cell polyurethane foam with a density of about 20 pounds per cubic foot) compressed between the relatively moveable portions of the paper holder 10. Those friction members include two friction washers 49 between adjacent surfaces of the hinge members 36 and 37, a friction washer 50 within the collar between the first hinge member and the slide bar 41, and a friction pad 51 retained by tabs 52 along the slide bar 41 that engage openings in the friction pad 51 with spaced portions of the friction pad that project past the tabs 52 on both sides of the pad 51 engaging the rails 42 and the friction pad 51 particularly including those portions being resiliently compressed between the rails 42.

A paper support shelf 54 projecting from the front surface 15 of the support plate 14 is attached at the bottom edge 17 of the support plate 14 by spaced projections 55 from the shelf 54 along its front and rear surfaces 15 and 16. The paper support shelf 54 has spaced parallel grooves along its upper surface and an upwardly projecting lip 56 along its outer edge that help retain the bottom edge of a sheet of paper on the shelf 54.

An elongate reading guide 57 has one end portion 58 adapted to frictionally engage and move along one of two channels defining the side edges 20 of the sheet support plate 14 with the reading guide 54 projecting over a paper along its front surface 15. A privacy screen of the type described in U.S. patent application Ser. No. 08/263450, filed Jun. 21, 1994, (the content whereof is incorporated herein by reference) may also be adapted to engage one or both of the channels defining the side edges 20 so that it may overlay a document on the front surface 15 of the sheet support plate 14, and thereby restrict the angle at which that document may be viewed.

Figure 2:
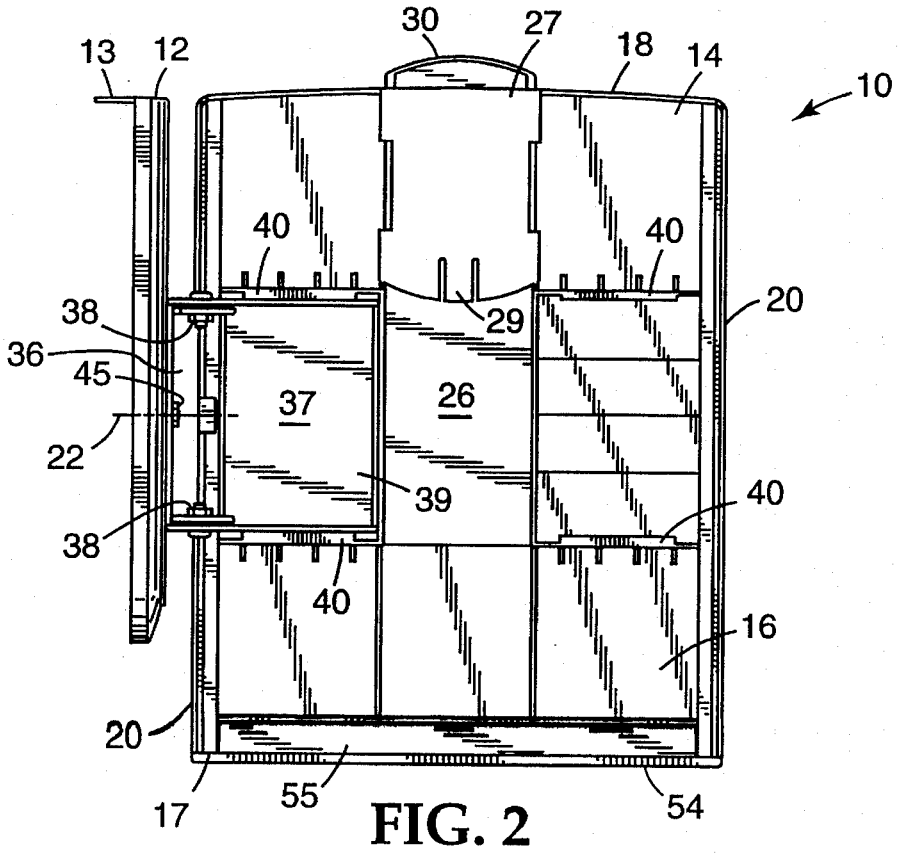
FIG. 2 is a rear view of the adjustable paper holder of FIG. 1 in which the support member is located on the right side of the sheet support plate.
Figure 3:
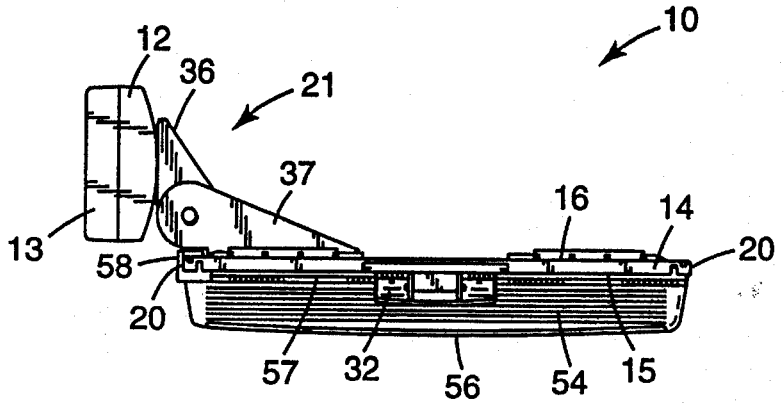
FIG. 3 is a top view of the adjustable paper holder configured as illustrated in FIG. 1.
Figure 4:
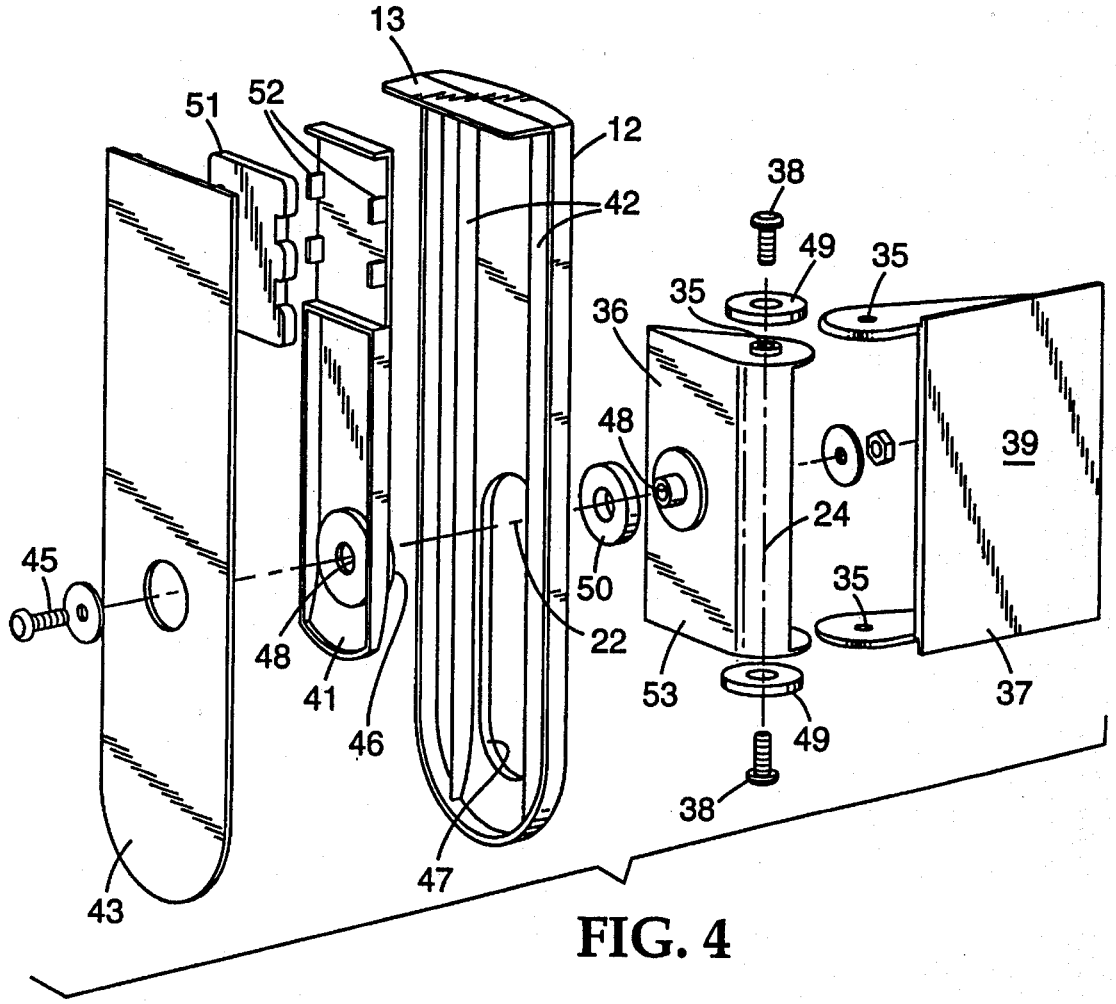
FIG. 4 is an exploded top left front perspective view of a first subassembly included in the adjustable paper holder of FIG. 1.
Figure 5:
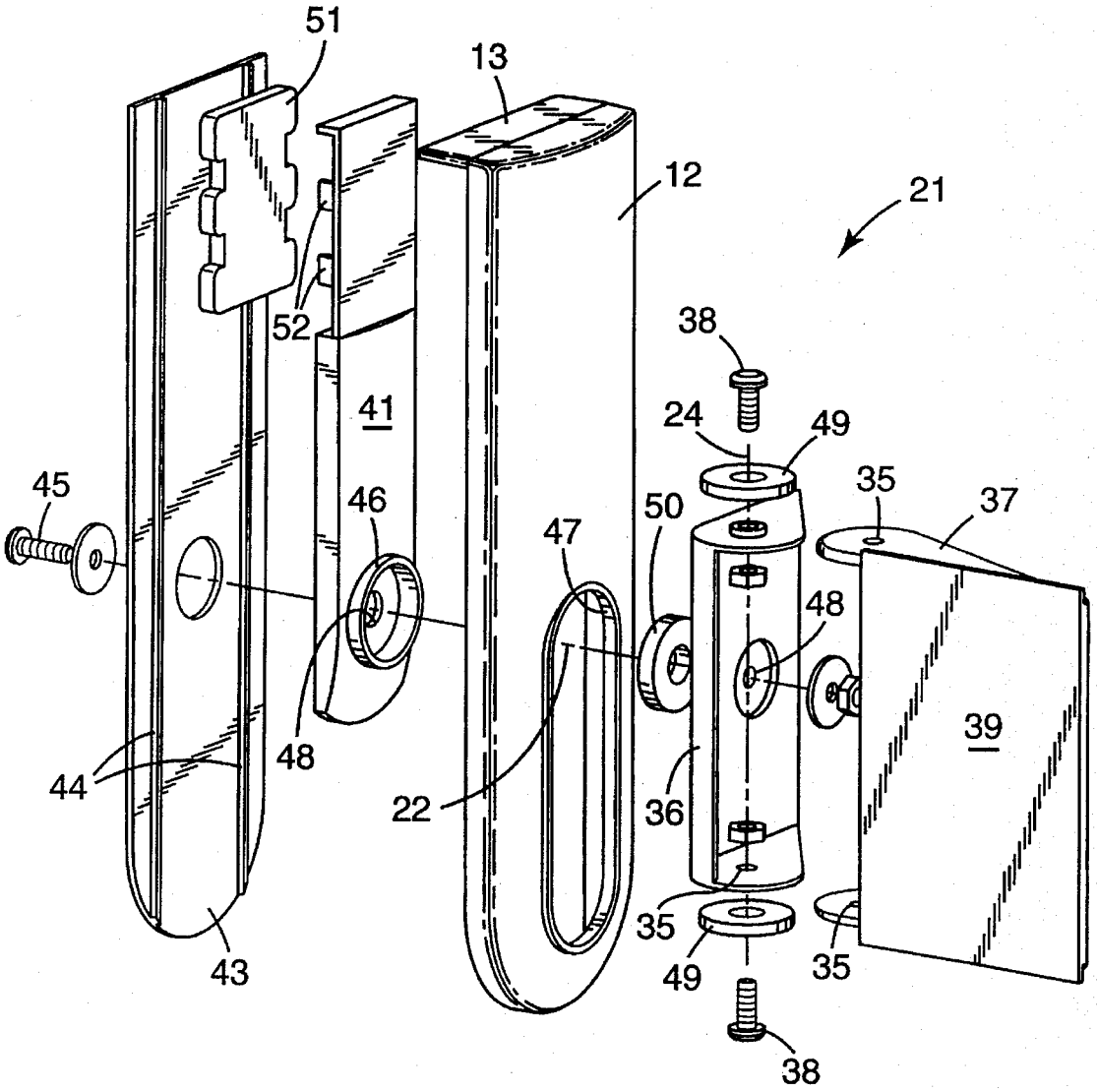
FIG. 5 is an exploded top right front perspective view of the first subassembly illustrated in FIG. 4.
Figure 6:
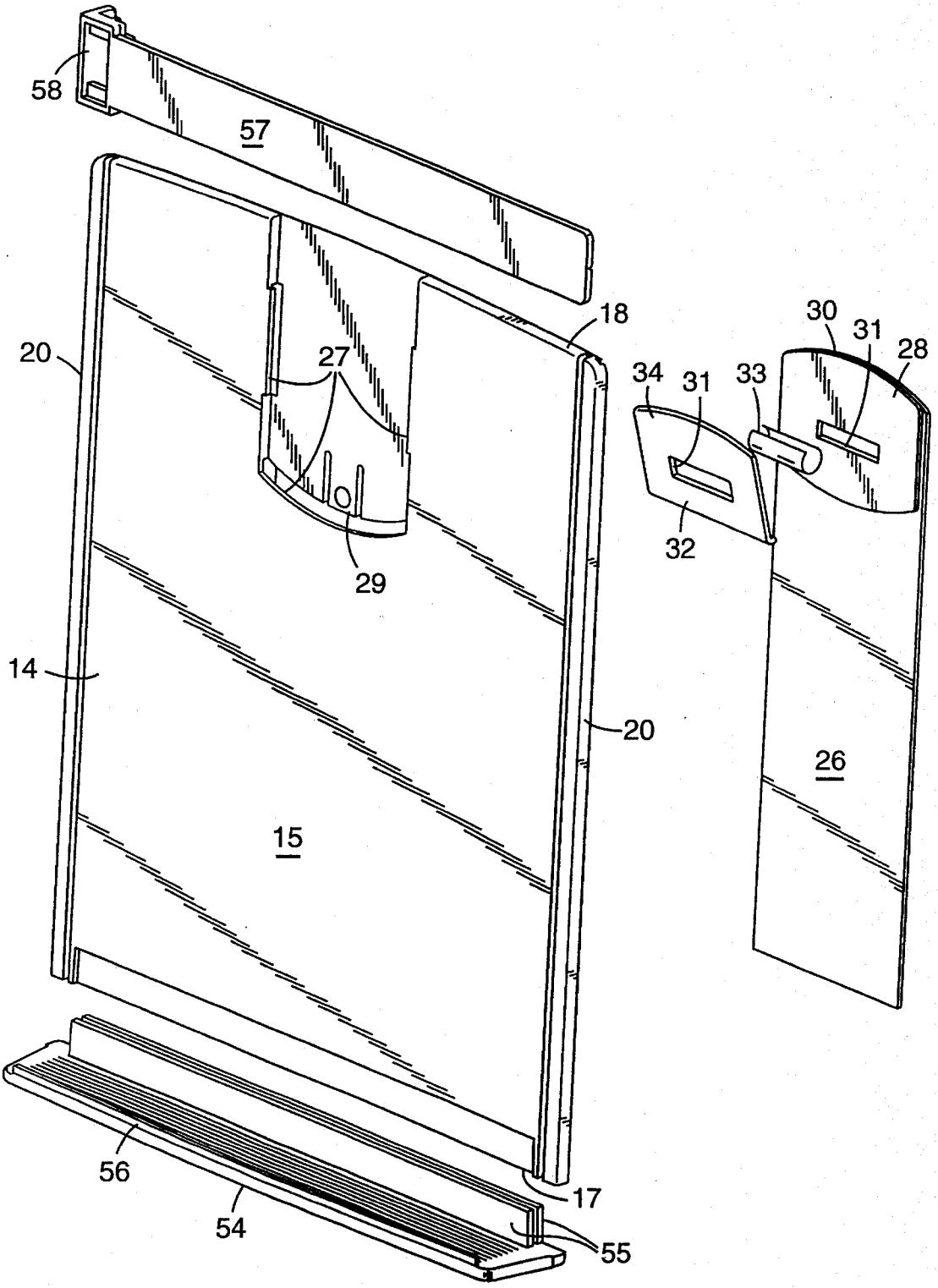
Figure 7:
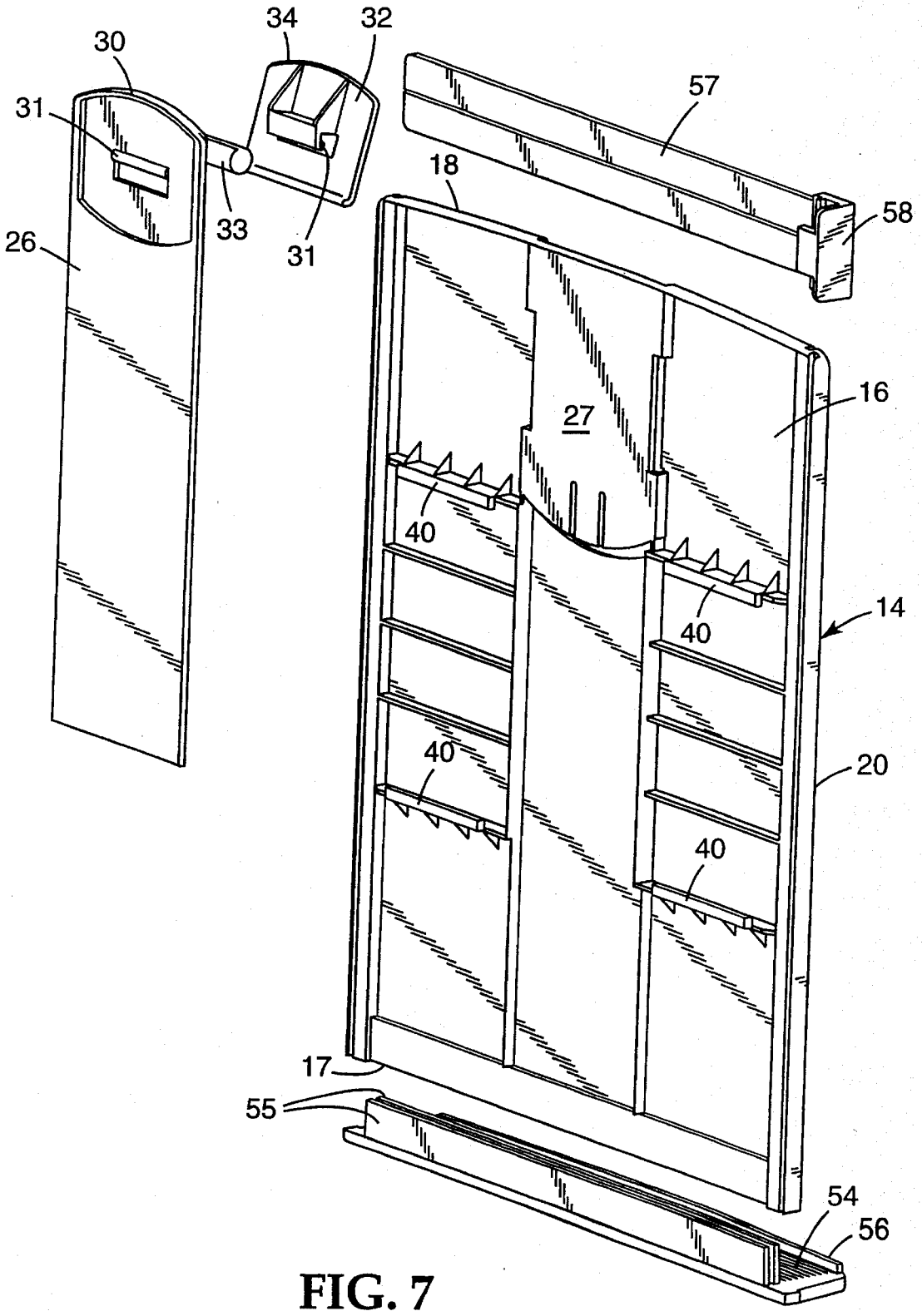
FIG. 7 is an exploded top right rear perspective view of the second subassembly illustrated in FIG. 6.

A user of the paper holder 10 may attach it to either side of a computer monitor using attachment means between the side surface of the monitor and the outer surface of the retaining plate 43 such as hook and loop fasteners (one portion of which is adhered to the monitor and the other to the outer surface of the retaining plate 43) or strips of material such as foam having pressure sensitive adhesive along opposite major surfaces. As illustrated in FIG. 1, it may be attached to the right side of the computer monitor, and it may be easily modified for attachment to the left side of the computer monitor (as illustrated in FIG. 2) by pulling the projecting portion 39 of the second hinge member 37 from between the rails 40 on the rear right side of the sheet support plate 14, rotating the hinge members 36 and 37 about 180 degrees around the horizontal axis 22, and inserting the projecting portion 39 between the rails 40 on the rear left side of the sheet support plate 14. On which ever side it is mounted, the user may slide the sheet support plate 14 up and down between its first and second positions relative to the support member 12 within the limits defined by the ends of the slot 47, and may pivot it about either or both of the horizontal and pivot axes 22 and 24 to a desired position relative to the computer monitor.

The present invention has now been described with reference to one embodiment thereof. It will be apparent to those skilled in the art that many changes can be made in the embodiment described without departing from the scope of the present invention. Thus the scope of the present invention should not be limited to the structures described in this application, but only by structures described by the language of the claims and the equivalents of those structures.

We claim:

1. An adjustable paper holder for use on a computer monitor having a viewed front surface and normally vertical opposite side surfaces disposed at about right angles with respect to said viewed surface, said paper holder comprising:

an elongate support member adapted to be attached along either one of the side surfaces of the monitor with the length of the support member extending generally parallel to said front surface;

a sheet support plate having front and rear major surfaces, a bottom edge, an opposite top edge, side edges extending between said top and bottom edges, and a paper support shelf along said bottom edge adapted for supporting the bottom edge of a sheet along said front major surface;

means mounting said sheet support plate on said support member for pivotal movement around a first normally horizontal pivot axis generally normal to the length of said support member and parallel to the front surface of a computer monitor to which the support member is attached, and for pivotal movement around a second pivot axis parallel to the edges of the sheet support plate and adjacent one of said edges, and for movement of said normally horizontal pivot axis between first and second positions longitudinally of said support member, said means for mounting said sheet support plate on said support member including a slide bar mounted on said support member for longitudinal sliding movement, and said slide bar including means for defining a portion of said first normally horizontal pivot axis, with sliding movement of said slide bar causing said movement of said normally horizontal pivot axis between said first and second positions longitudinally of said support member;

means including resiliently compressible friction members compressed between relatively movable portions of said paper holder including between said slide bar and said support member for affording relative movement between said portions about said first and second axes and between said first and second positions upon application of a significant manual force to produce said movement and, upon termination of said manual force, for frictionally retaining said sheet support plate at any desired position relative to said support member that said support plate can be moved by said mounting means without changing the compression of said friction members;

a clamp assembly comprising a clamp plate having a planar clamping surface and an upper edge, a clamp, means for mounting said clamp on said clamp plate along said upper edge for movement between a clamping position engaged with the edge portion of a sheet of paper along said clamping surface, and a release position spaced from said clamping surface, and means for biasing said clamp to said clamping position, said clamp being manually engageable to move said clamp to said release position; and means mounting said clamp plate on said sheet support plate with said upper edge of said clamp plate generally parallel with the paper support shelf of said sheet support plate for movement between a legal paper position and a landscape position with said clamp spaced closer to the paper support shelf at the bottom edge of said sheet support plate at said landscape position than at said legal paper position.

2. An adjustable paper holder according to claim 1 wherein in said legal paper position said clamp is spaced about 14 inches from the paper support shelf at the bottom edge of said sheet support plate, and in said landscape position said clamp is spaced about 8 inches from the paper support shelf at the bottom edge of said sheet support plate.

3. An adjustable paper holder according to claim 2 wherein said means for mounting said clamp plate on said sheet support plate for movement to positions between a legal paper position and a landscape position with said clamp spaced closer to the paper support shelf at the bottom edge of said sheet support plate in said landscape position than in said legal paper position comprises said sheet support plate including walls defining a channel extending parallel to said front surface at a right angle to said paper support shelf with a portion of said channel opening through the front surface of said sheet support plate for a distance from said top edge of said paper support sheet toward said support shelf, and said clamp plate including a clamping portion defining said clamping surface and a support portion recessed and projecting from said clamping portion, said support portion being mounted in said channel for sliding movement between positions with said clamping portion along the opening of said channel through the front surface of said sheet support plate and positions with said clamping portion projecting above the top edge of said sheet support plate.

4. An adjustable paper holder for use on a computer monitor having a viewed front surface and normally vertical opposite side surfaces disposed at about right angles with respect to said viewed surface, said paper holder comprising:

an elongate support member adapted to be attached along either one of the side surface of the monitor with the length of the support member extending generally parallel to said front surface;

a sheet support plate having front and rear major surfaces, a bottom edge, an opposite top edge, side edges extending between said top and bottom edges, and a paper support shelf along said bottom edge adapted for supporting the bottom edge of a sheet along said front major surface;

means mounting said sheet support plate on said support member for pivotal movement around a first normally horizontal pivot axis generally normal to the length of said support member and parallel to the front surface of a computer monitor to which the support member is attached, and for pivotal movement around a second pivot axis parallel to the edges of the sheet support plate and adjacent one of said edges, and for movement of said normally horizontal pivot axis between first and second positions longitudinally of said support member, said means for mounting said sheet support plate on said support member for pivotal movement around said second pivot axis comprising first and second hinge members having pivot portions mounted on each other for pivotal movement around said second pivot axis, said second hinge member having a rectangular projecting portion projecting at about a right angle to said second pivot axis, said sheet support plate having spaced rails along said rear surface, said spaced rails having distal edges and opposed lips projecting toward each other from said distal edges for frictionally and removably receiving said rectangular projecting portion with said pivot portion adjacent either of the edges of the sheet support plate; said first hinge member having a projecting portion projecting at about a right angle to said second pivot axis and including means defining at least a portion of said first normally horizontal pivot axis;

means for frictionally retaining said sheet support plate at any desired position relative to said support member that said support plate can be moved by said mounting means;

a clamp assembly comprising a clamp plate having a planar clamping surface and an upper edge, a clamp, means for mounting said clamp on said clamp plate along said upper edge for movement between a clamping position engaged with the edge portion of a sheet of paper along said clamping surface, and a release position spaced from said clamping surface, and means for biasing said clamp to said clamping position, said clamp being manually engageable to move said clamp to said release position; and means for mounting said clamp plate on said sheet support plate with said clamping surface of said clamp plate generally co-planar with the front surface of said sheet support plate and said upper edge of said clamp plate generally parallel with the paper support shelf for movement between a legal paper position, to a landscape position with said clamp spaced closer to the paper support shelf at the bottom edge of said sheet support plate than in said legal paper position.

5. An adjustable paper holder according to claim 4 wherein said means for mounting said sheet support plate on said support member further includes a slide bar mounted on said support member for longitudinal sliding movement, and said slide bar includes means for defining a portion of said first normally horizontal pivot axis, with sliding movement of said slide bar causing said movement of said normally horizontal pivot axis between first and second positions longitudinally of said support member; and said means for frictionally retaining said sheet support plate at any desired position relative to said support member that said support plate can be moved by said mounting means includes resiliently compressible friction members compressed between relatively movable portions of said paper holder.

6. An adjustable paper holder adapted for use on a computer monitor having a viewed front surface and normally vertical opposite side surfaces disposed at about right angles with respect to said viewed surface, said paper holder comprising:

a support member adapted to be attached to the monitor;

a sheet support plate having front and rear major surfaces, a bottom edge, an opposite top edge, side edges extending between said top and bottom edges, and a paper support shelf along said bottom edge adapted for supporting the bottom edge of a sheet along said front major surface;

mounting means for mounting said sheet support plate on said support member;

a clamp plate having a planar clamping surface and an upper edge, a clamp, means mounting said clamp on said clamp plate along said upper edge for movement between a clamping position engaged with the edge portion of a sheet of paper along said clamping surface, and a release position spaced from said clamping surface, and means for biasing said clamp to said clamping position, said clamp being manually engageable to move said clamp to said release position; and means for mounting said clamp plate on said sheet support plate for movement to positions between a legal paper position, and a landscape position with said clamp spaced closer to the paper support shelf at the bottom edge of said sheet support plate in said landscape position than in said legal paper position, said clamping surface of said clamp plate being generally co-planar with the front surface of said sheet support plate and said upper edge or said clamp plate being generally parallel with the paper support shelf in all of said positions, said means for mounting said clamp plate on said sheet support plate comprising said sheet support plate including walls defining a channel extending parallel to said front surface at a right angle to said paper support shelf with a portion of said channel opening through the front surface of said sheet support plate for a distance from said top edge of said paper support sheet toward said support shelf, and said clamp plate including a clamping portion defining said clamping surface and a support portion recessed and projecting from said clamping portion, said support portion being mounted in said channel for sliding movement between positions with said clamping portion along the opening of said channel through the front surface of said sheet support plate and positions with said clamping portion projecting above the top edge of said sheet support plate.

7. An adjustable paper holder according to claim 6 wherein in said legal paper position said clamp is spaced about 14 inches from the paper support shelf at the bottom edge of said sheet support plate, and in said letter position said clamp is spaced about 8 inches from the paper support shelf at the bottom edge of said sheet support plate.

8. An adjustable paper holder for use on a computer monitor having a viewed front surface and normally vertical opposite side surfaces disposed at about right angles with respect to said viewed surface, said paper holder comprising:

an elongate support member adapted to be attached along either one of the side surfaces of the monitor with the length of the support member extending generally parallel to said front surface;

a sheet support plate having front and rear major surfaces, a bottom edge, an opposite top edge, and side edges extending between said top and bottom edges;

means mounting said sheet support plate on said support member for pivotal movement around a first normally horizontal pivot axis generally normal to the length of said support member and parallel to the front surface of a computer monitor to which the support member is attached, and for pivotal movement around a second pivot axis parallel to the edges of the sheet support plate and adjacent one of said edges, and for movement of said normally horizontal pivot axis between first and second positions longitudinally of said support member; and means for frictionally retaining said sheet support plate at any desired position relative to said support member that said support plate can be moved by said mounting means;

said means for mounting said sheet support plate on said support member for pivotal movement around said second pivot axis comprises first and second hinge members having pivot portions mounted on each other for pivotal movement around said second pivot axis, said second hinge member having a rectangular projecting portion projecting at about a right angle to said second pivot axis, said sheet support plate has spaced rails along said rear surface, said spaced rails having distal edges and opposed lips projecting toward each other from said distal edges for frictionally and removably receiving said projecting portion with said pivot portions adjacent either of the edges of the sheet support plate; said first hinge member has a projecting portion projecting at about a right angle to said second pivot axis and includes means defining at least a portion of said first normally horizontal pivot axis.

9. An adjustable paper holder according to claim 8 wherein said means for mounting said sheet support plate on said support member further includes a slide bar mounted on said support member for longitudinal sliding movement, and said slide bar includes means for defining a portion of said first normally horizontal pivot axis, with sliding movement of said slide bar causing said movement of said normally horizontal pivot axis between first and second positions longitudinally of said support member; and said means for frictionally retaining said sheet support plate at any desired position relative to said support member that said support plate can be moved by said mounting means includes resiliently compressible friction members compressed between relatively movable portions of said paper holder.

10. An adjustable paper holder for use on a computer monitor having a viewed front surface and normally vertical opposite side surfaces disposed at about right angles with respect to said viewed surface, said paper holder comprising:

a support member adapted to be attached along either one of the side surfaces of the monitor;

a sheet support plate having front and rear major surfaces, a bottom edge, an opposite top edge, and side edges extending between said top and bottom edges;

mounting means for mounting said sheet support plate on said support member for relative pivotal movement around a pivot axis parallel to the edges of the sheet support plate and adjacent one of said edges, and means for frictionally retaining said sheet support plate at any desired position relative to said support member that said support plate can be moved by said mounting means;

said means for mounting said sheet support plate on said support member for pivotal movement around said pivot axis comprises first and second hinge members having pivot portions mounted on each other for pivotal movement around said pivot axis, said second hinge member having a rectangular projecting portion projecting at about a right angle to said pivot axis, said sheet support plate has spaced rails along said rear surface, said spaced rails having distal edges and opposed lips projecting toward each other from said distal edges for removably receiving said projecting portion to support the sheet support plate from the projecting portion with said pivot portions adjacent either of the edges of the sheet support plate; said first hinge member has a projecting portion projecting at about a right angle to said pivot axis and supported by said support member.

* * * * *

UNITED STATES PATENT AND TRADEMARK OFFICE

CERTIFICATE OF CORRECTION

PATENT NO.: 5,620,162

DATED: April 15, 1997

INVENTOR(S): Tanya L. Beckwith, et al.

It is certified that error appears in the above-identified patent and that said Letters Patent is hereby corrected as shown below:

Column 6, line 20, claim 3, "claim 2" should be --claim 1--.

Signed and Sealed this

Seventeenth Day of February, 1998

*Attest:*

Bruce Lehman

BRUCE LEHMAN

*Attesting Officer*

*Commissioner of Patents and Trademarks*